US006615419B1

(12) United States Patent
Chang

(10) Patent No.: US 6,615,419 B1
(45) Date of Patent: Sep. 9, 2003

(54) SAUNA DEVICE

(76) Inventor: Chung-Tai Chang, No. 149, (Room 9, 10/F.) Lin Sen Road, Sec. 1, Tainan (TW)

( * ) Notice: Subject to any disclaimer, the term of this patent is extended or adjusted under 35 U.S.C. 154(b) by 0 days.

(21) Appl. No.: 10/225,348

(22) Filed: Aug. 22, 2002

(30) Foreign Application Priority Data

Aug. 27, 2001 (CN) ..... 01 2 59546

(51) Int. Cl.[7] ..... A61H 33/06
(52) U.S. Cl. ..... 4/524; 4/526; 4/527
(58) Field of Search ..... 4/524–534

(56) References Cited

U.S. PATENT DOCUMENTS 2,406,222 A * 8/1946 Howard ..... 4/532
3,092,843 A * 6/1963 Wright ..... 4/527
4,031,573 A * 6/1977 Romanoff ..... 4/532
4,157,179 A * 6/1979 Ecklor, Jr. ..... 482/130
4,833,739 A * 5/1989 Sakakibara et al. ..... 4/524
4,899,403 A * 2/1990 Yamasaki ..... 5/600
6,129,651 A * 10/2000 Denaro ..... 482/141
6,148,450 A * 11/2000 Nicholas ..... 4/526
6,157,005 A * 12/2000 Lu ..... 4/531
6,276,001 B1 * 8/2001 Chen ..... 4/527

FOREIGN PATENT DOCUMENTS

DE 3103329 A1 * 9/1982 ..... 4/534

* cited by examiner

*Primary Examiner*—Gregory L. Huson
*Assistant Examiner*—Khoa D. Huynh

(57) ABSTRACT

A sauna device includes a chamber made of an air-proof material. The chamber is assembled inside and supported with a flexible and collapsible support frame and provided with a vertical zipper at the front side for pulling open and close, having a through hole in the top side. A heating unit is placed in the chamber, having two heaters respectively fixed at the opposite ends of a telescopic bottom base. A PTC heating member is installed in the interior of each heater and an electric fan is positioned behind the heating member. Thus, when the wind produced by the electric fan blows through the heating member, the hot air produced in the chamber will be agitated to form up-and-down convection and evenly spread all over the interior of the chamber for use.

4 Claims, 6 Drawing Sheets

SAUNA DEVICE

BACKGROUND OF THE INVENTION

This invention relates to a sauna device, particularly to one provided in the interior of a chamber with heaters made of PTC heating members emitting both heat and remote infrared ray to form an agitated current of air inside to make heat and temperature evenly spread all over the interior of the chamber for helping a user to sweat, easy to be collapsed for storing as well.

A conventional sauna device includes a chamber made of an air-proof and waterproof material, and a steamer positioned outside the chamber. The chamber is provided with a zipper for pulling open and close and a through hole in the topside for the head of a user to extend out therethrough, having a chair inside. The steamer has a pipe communicating with the interior of the chamber. In using, the steamer is first filled in with a proper amount of fresh water or fresh water added with liquid of medicinal herbs, and then the steam produced by the steamer is led into the chamber for use through the pipe.

However, the steam produced by the steamer and incessantly led into the chamber for use may accumulate in the chamber and adhere to its wall to condense into drops of water, thus wetting the interior of the chamber and causing trouble in cleaning. Besides, if the steam in the chamber becomes excessive, the relative humidity inside will increase, and the result is that it is not easy for a user to sweat, making the user feel uncomfortable. To solve the above-mentioned problem, a dry-type sauna device has been developed to take the place of the steam sauna device. The dry-type sauna device has a plurality of electric heat plates adhered to the inner wall of a chamber made of high temperature-enduring material to let these electric heat plates electrified to produce high temperature for use. Nevertheless, heat produced by the electric heat plates is concentrated at certain parts and can hardly spread all over the chamber evenly, and sometimes a user may be scalded in case of touching the electric heat plates by accident or carelessness.

SUMMARY OF THE INVENTION

The objective of the invention is to offer a sauna device able to transmit hot wind together with remote infrared rays to quickly heighten the temperature inside a chamber and evenly spread the hot air all over the interior of the chamber, enabling a user to sweat quickly and convenient to be collapsed for storing.

The sauna device in the invention includes a chamber made of air-proof material and assembled and supported inside with a flexible and collapsible support frame. The chamber is provided with a vertical zipper at the front side for pulling open and close and a through hole in the topside for the head of a user to extend out therethrough. A heating unit is placed in the interior of the chamber, having two heaters respectively fixed at the opposite ends of a telescopic bottom base. Each heater has a front and a rear netted faceplate and is installed inside with a PTC heating member controlled by a temperature switch and fuse in the interior, with an electric fan positioned behind the heating member. Thus, the wind produced by the electric fan blows through the heating member to let the hot air in the chamber become an agitated current of air spreading all over the chamber evenly.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
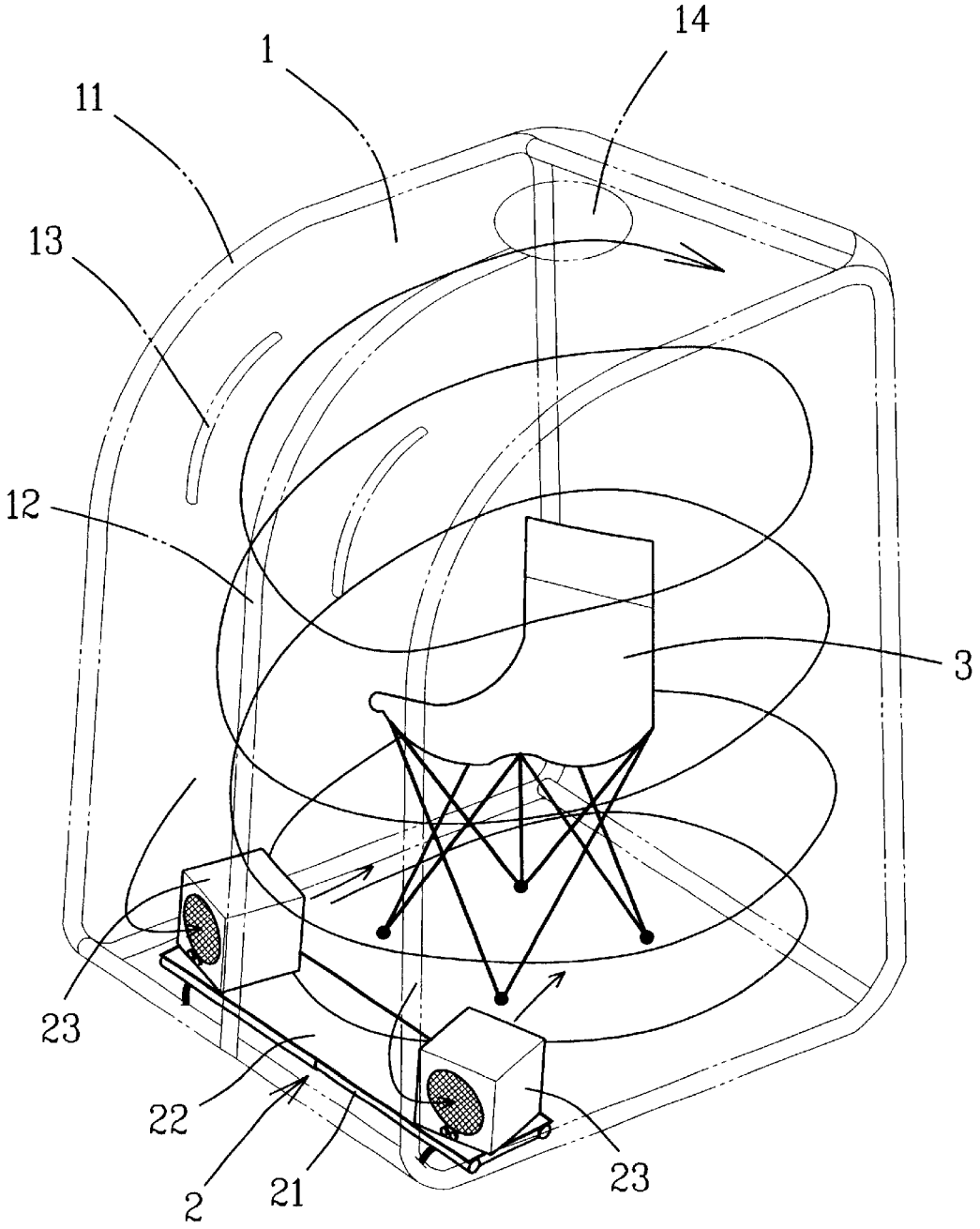
FIG. 1 is perspective view of a sauna device in the present invention.

A preferred embodiment of a sauna device in the present invention, as shown in FIG. 1, includes a chamber 1 and a heating unit 2 as main components combined together.

Figure 2:
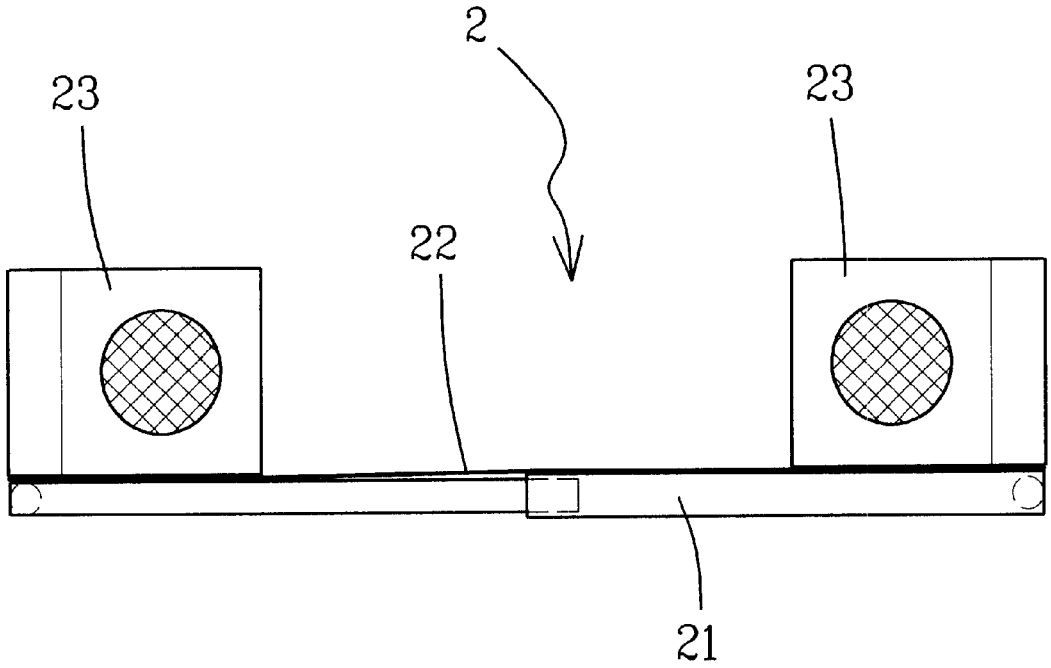
FIG. 2 is front view of the heating unit of the sauna device in the present invention.
Figure 3:
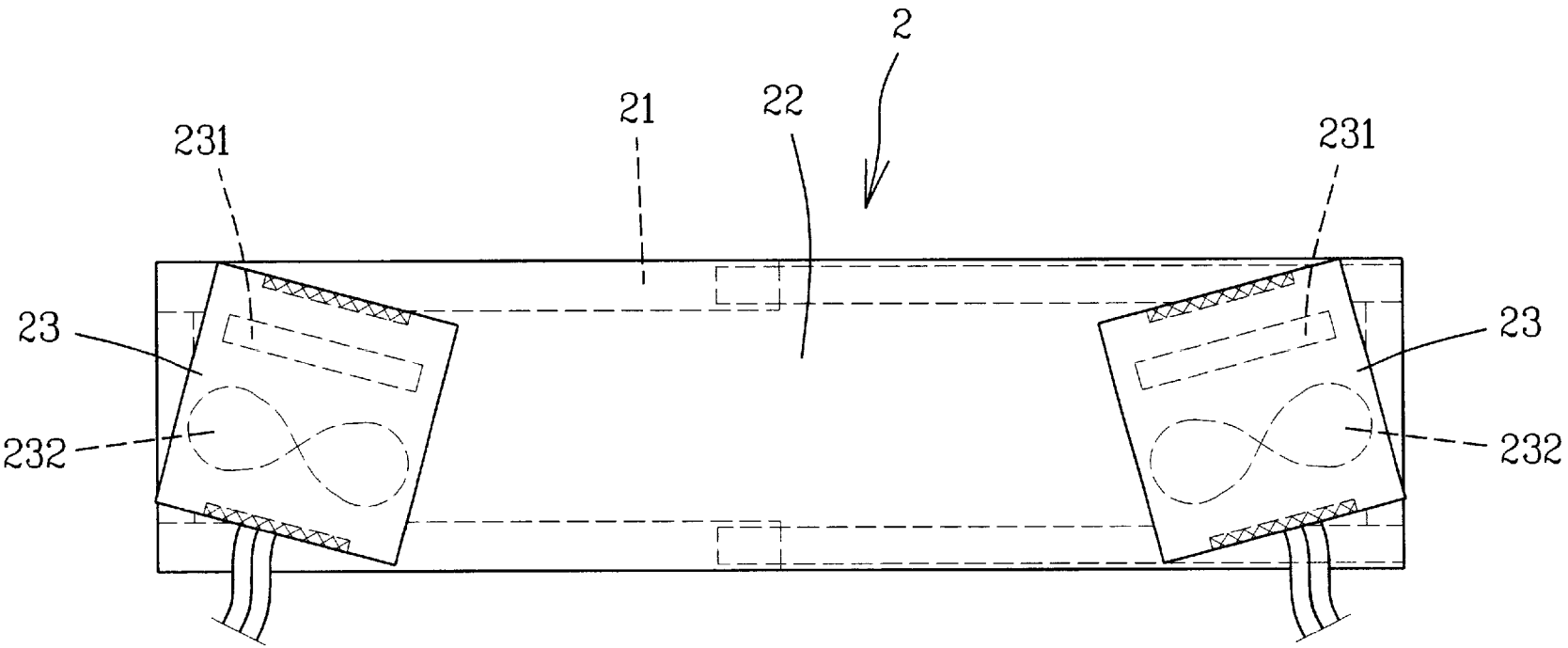
FIG. 3 is an upper view of the heating unit of the sauna device in the present invention.

The chamber 1 is made of a double-layer and air-proof material and the material of its inner layer has function of heat reflection. The chamber 1 is assembled and supported with a flexible and collapsible support frame 11 inside, and has a zipper 12 vertically positioned in the center portion of the front side for pulling open and close to enable a user to get in and get out, two short slits 13 respectively bored at a proper height at the opposite sides of the zipper 12 and a through hole 14 bored in the top side respectively for the hands and the head of a user to extend out therethrough. A heating unit 2 controlled by a linear controller is placed in the interior of the chamber 1, as shown in FIG. 2, having a telescopic bottom base 21 provided with an inner and an outer tube fitted with each other. The telescopic bottom base 21 is fixed with a connecting member (cloth) 22 to control a telescopic width and has two heaters 23 respectively secured at the opposite sides and slanting a little to each other, as shown in FIG. 3. Each heater 23 has a front and a rear netted faceplate respectively functioning as a wind outlet and a wind inlet, and is provided inside with a PTC heating member 231, with an electric fan 232 positioned behind the heating member 231. The PTC heating member 231 can emit both heat and infrared ray at the same time.

Figure 4:
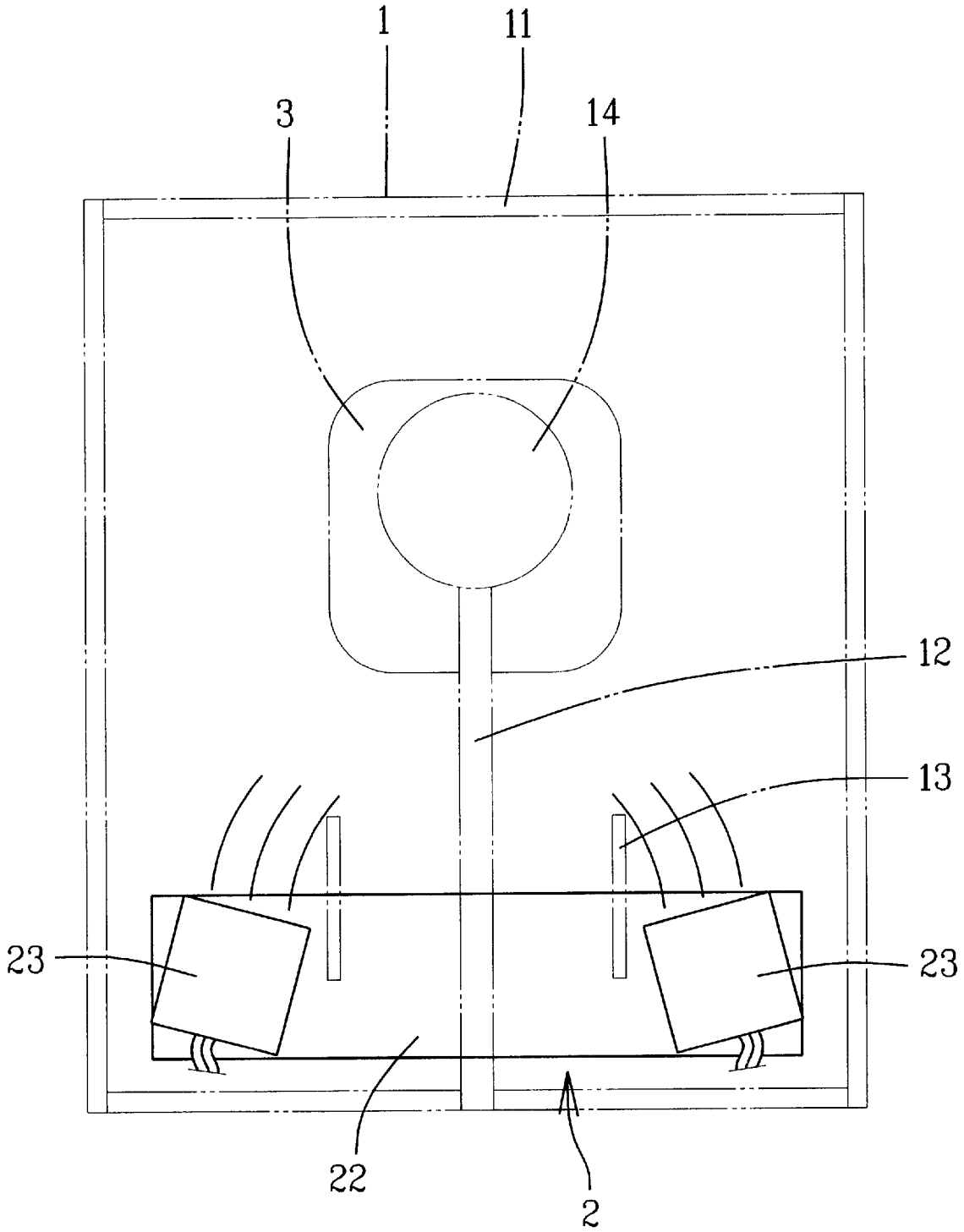
FIG. 4 is an upper view of the sauna device in the present invention.
Figure 5:
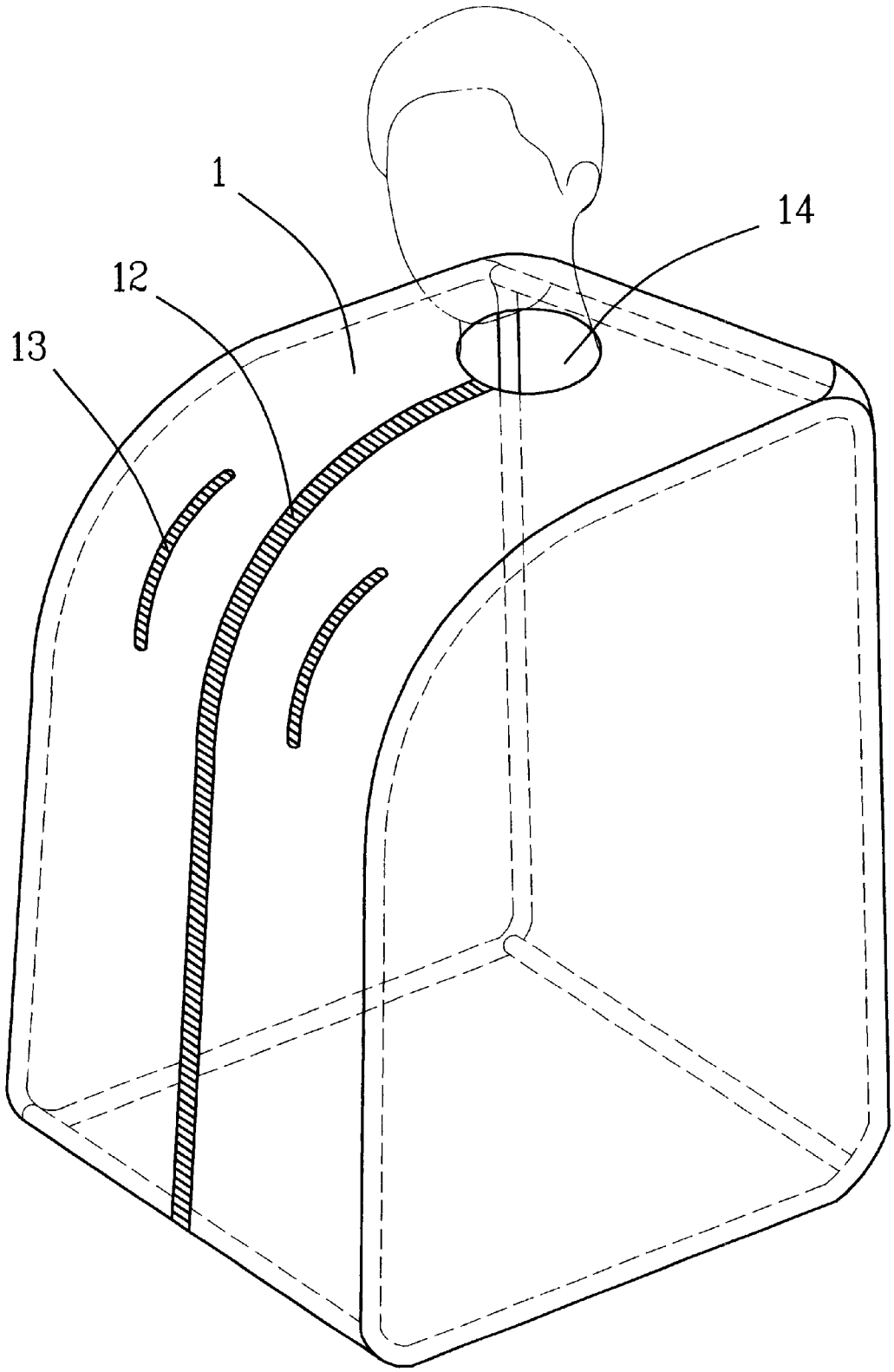
FIG. 5 is a perspective view of the sauna device in a using condition in the present invention.

In using, as shown in FIGS. 1, 4 and 5, a chair 3 is first placed in the chamber 1 with the heating unit 2 positioned in front of the chair 3, letting the front netted faceplates of the two heaters 23 face the chair 3, as shown in FIGS. 1 and 4. When a user enters the chamber 1 and sits in the chair 3 with his/her head extending out of the through hole 14 in the top side of the chamber 1, the user pulls close the zipper 12, as shown in FIG. 5 and has two hands respectively stretch out of the two short slits 13 to make the heating unit 2 electrified to give out heat and infrared ray. At this time, the temperature of the PTC heating members 231 in the heaters 23 begins to rise and the electric fan 232 blows the hot air toward the user and form an up-and-down convective hot current of air inside the chamber 1, as shown in FIG. 1. Besides, during heating, the PTC heating member 231 will produce remote infrared rays which can get into a human body to diminish the water molecule therein and exhaust out the waste and poison in cells of the human body, advantageous to blood circulation and having effect of activating cells.

Figure 6:
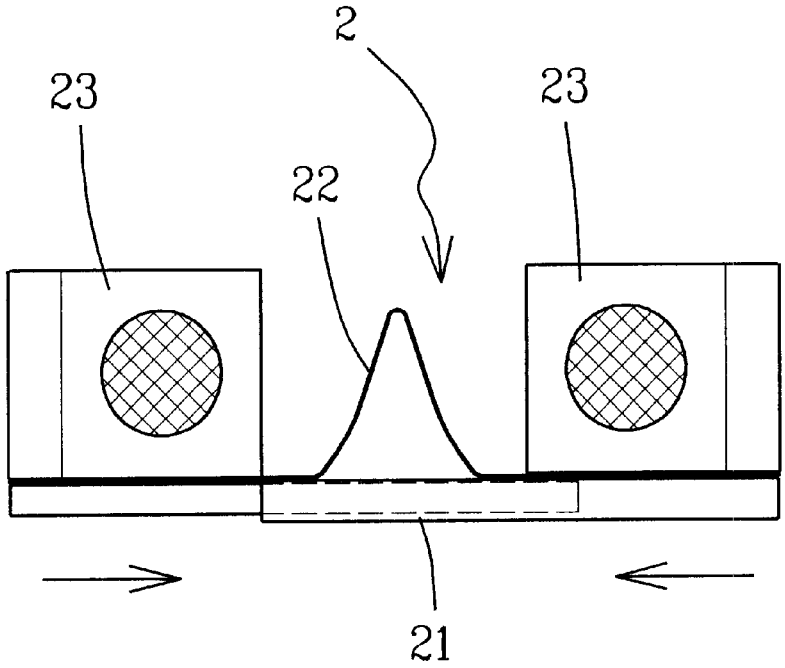
FIG. 6 is a front view of the heating unit being collapsed in the present invention.
Figure 7:
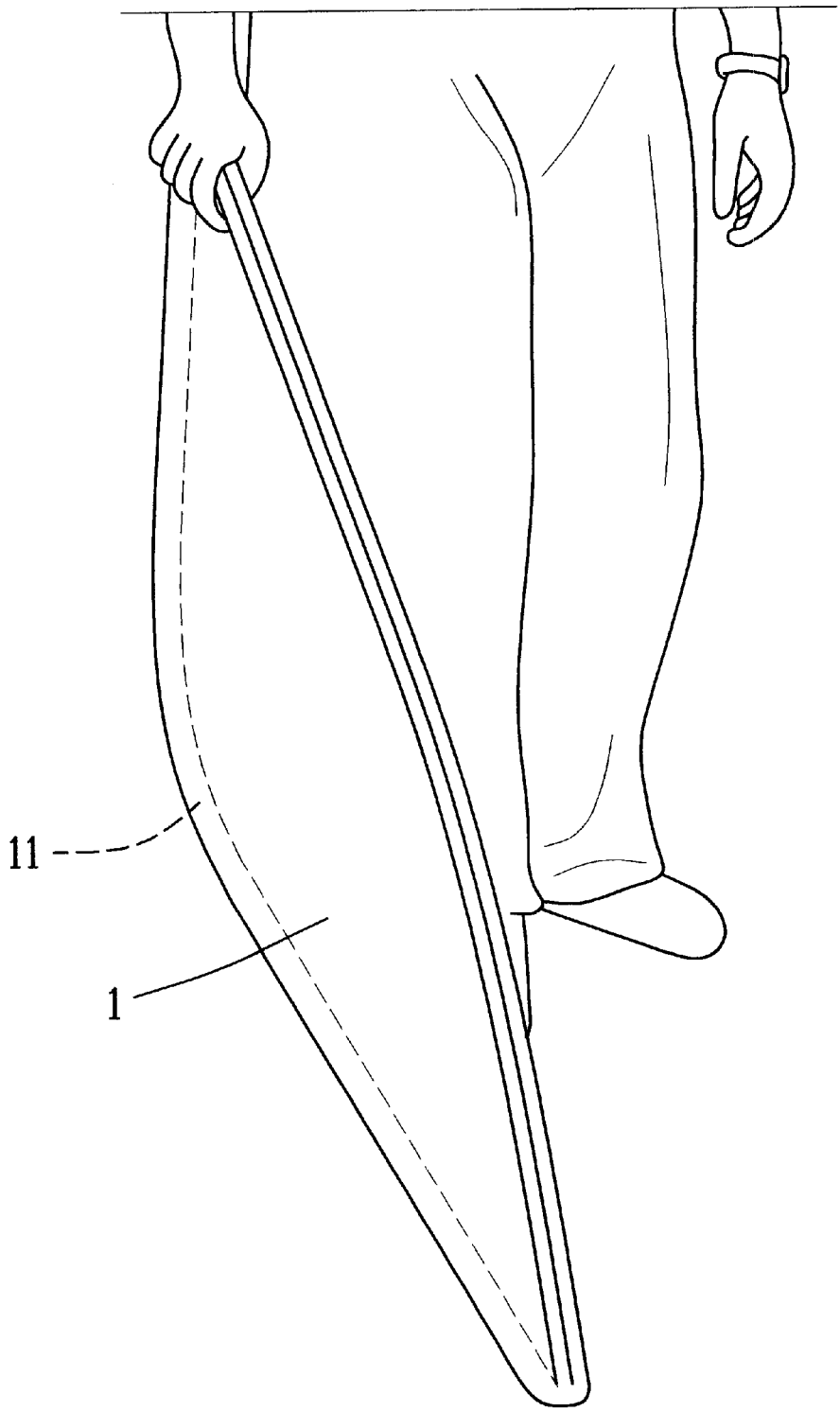
FIG. 7 is a perspective view of the chamber of the sauna device in a collapsed condition in the present invention.

In addition, the sauna device in this invention is collapsible to diminish its size. After used, the heating unit 2 can be removed out of the chamber 1, the two heaters 23 can be moved closer to each other, and the inner tube of the telescopic bottom base 21 can be telescoped into the outer tube to shorten the length of the heating unit 2, as shown in FIG. 6. Further, the chamber 1 is made of cloth and the support frame 11 is flexible so they can be bent and collapsed, as shown in FIG. 7.

As can be noted from the above description, this invention has the following advantages.

1. It eliminates the defects of the conventional steam and dry-type sauna device described above, that it is easy to become damp and hard to clean up, and that the heat is concentrated unable to circulate around the chamber and it is liable to result in an accident of scalding.

2. The chamber 1 and the supporting frame are collapsible to diminish their size, convenient for carrying about and storing, as shown in FIG. 7.

3. The PTC heating members 231 of the heating unit 2 are able to produce both heat and remote infrared rays, which have functions of helping blood circulation and activating cells of a human body.

4. The electric fan 232 located behind the heating member 231 enables the hot air in the chamber 1 to be agitated and form an up-and-down convective hot air current to let a user get warmed up evenly.

While the preferred embodiment of the invention has been described above, it will be recognized and understood that various modifications may be made therein and the appended claims are intended to cover all such modifications that may fall within the spirit and scope of the invention.

I claim:

1. A collapsible sauna comprising:

a chamber made of an air-proof material and provided with a zipper positioned vertically in a center portion of a front side for opening and closing said chamber, and a through hole in a top side;

a support frame being flexible and collapsible, and positioned in said chamber for supporting said chamber;

a heating unit placed in the interior of said chamber, said heating unit having two heaters positioned at the front side of the chamber, each of said heaters having a front end and a rear end, said front end and said rear end of each of said heaters respectively formed with a wind outlet and a wind inlet, each of said heaters provided with a heating member, and an electric fan positioned behind said heating member; and, said electric fan blowing wind through said heating members to let the wind become hot air, said hot air in said chamber forming an agitated current of air to spread all over said chamber;

wherein, said heating unit is provided with a telescopic bottom base for supporting said two heaters at opposite upper sides, the telescopic bottom base is provided with an inner tube and an outer tube fitted with each other, and the telescopic bottom base is fixed with a connecting cloth.

2. The collapsible sauna as claimed in claim 1, wherein the inner layer of said chamber is made of a material capable of reflecting heat.

3. The collapsible sauna as claimed in claim 1, wherein said heaters are positioned slanting to each other and facing a user.

4. The collapsible sauna as claimed in claim 1, wherein said heating members in said heaters are PTC heating members.

* * * * *